US006655971B2

(12) United States Patent
Maegawa

(10) Patent No.: US 6,655,971 B2
(45) Date of Patent: Dec. 2, 2003

(54) LEVER-TYPE CONNECTOR WITH A PEAK OPERATION RESISTANCE SHORTLY BEFORE COMPLETE CONNECTION

(75) Inventor: Takao Maegawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/158,280

(22) Filed: May 29, 2002

(65) Prior Publication Data

US 2002/0182491 A1 Dec. 5, 2002

(30) Foreign Application Priority Data

Jun. 26, 2001 (JP) ..... 2001-192649

(51) Int. Cl.[7] ..... H01R 13/62
(52) U.S. Cl. ..... 439/157; 439/372
(58) Field of Search ..... 439/152–160, 439/372, 341, 351–358

(56) References Cited

U.S. PATENT DOCUMENTS 5,474,462 A * 12/1995 Yamanashi ..... 439/157
5,484,297 A * 1/1996 Takahashi et al. ..... 439/157
5,562,465 A 10/1996 Taguchi et al. ..... 439/157

* cited by examiner

*Primary Examiner*—Lynn Feild
*Assistant Examiner*—Son V. Nguyen
(74) *Attorney, Agent, or Firm*—Gerald E. Hespos; Anthony J. Casella

(57) ABSTRACT

A lever-type connector has first and second housings (10, 20) that can be mated with one another. A lever (30) is mounted rotatably on the first housing (10). A cam groove (35) is formed on the lever (30) and engages a follower pin (22) on the second housing (20) to connect the housings (10, 20). The cam groove (35) has steep surface area (45) whose distance from a center of rotation of the lever (30) decreases at a higher rate than the other areas of the cam groove (35) and is formed at a position of the cam groove (35) slightly before a terminus end (35B). Thus, an operation resistance peaks when follower pins (22) reach the steep surface areas (45). This peak operation resistance is larger than a sum of a resistance required to engage a lock (41) with a projection (26) and a connection resistance acting between housings (10, 20).

13 Claims, 6 Drawing Sheets

LEVER-TYPE CONNECTOR WITH A PEAK OPERATION RESISTANCE SHORTLY BEFORE COMPLETE CONNECTION

BACKGROUND OF THE INVENTION

1. Field of the Invention

The invention relates to a lever-type connector and to a method for assembling such a connector.

2. Description of the Related Art

Lever-type connectors facilitate the mating of two connector housings, and are used in multi-contact connectors and other situations where a large connecting force is required. A known lever-type connector has male and female housings configured for mating with one another. A lever is mounted pivotally on the male housing and is formed with a cam groove. The female housing is formed with a follower configured for engagement in the cam groove at the beginning of the mating process. The cam groove has a side surface that pushes the follower as the lever is pivoted and moves the housings into a fully mated condition. A locking mechanism is provided between the lever and the mating housing to lock the housings in a fully mated condition.

The pivoting movement of the lever may be interrupted before the housings are connected properly. U.S. Pat. No. 5,562,465 shows a connector that attempts to avoid such a problem. This connector has a lever with an integral spring piece, and a mating housing with a striking portion disposed for engagement by the spring piece near the end of the pivotal movement of the lever. Thus, pivoting movement of the lever deforms the spring piece as the housings approach a fully connected condition. The locked engagement of two properly connected housings resists the resilient restoring forces of the spring piece. However, the restoring force of the spring piece pushes the lever back, if the housings are not locked together. In this way, partial connection of the housings is identified.

Connection can be detected satisfactorily in the prior art connector. However, the spring piece is left resiliently deformed after the housings are connected properly and locked together. Thus, the spring piece may experience a permanent set and may fatigue over time. As a result, the spring piece cannot be expected to display a connection detecting function when the two housings are reconnected after being separated for maintenance or other reason. Therefore, there has been a demand for a new means.

The present invention was developed in view of the above problem, and an object thereof is to allow two housings of a lever-type connector to be connected properly with high reliability.

SUMMARY OF THE INVENTION

The invention is directed to a lever-type connector with first and second housings that are connectable with each other. A lever is supported pivotally on the first housing and has at least one curved cam surface that gradually approaches the center of rotation of the lever. At least one follower is provided on the second housing and is engageable with the cam surface so that the housings are connected as the lever is pivoted. A resistance means is provided for giving a peak operation resistance to the lever when the lever is pivoted to a position immediately before the housings are connected properly.

A locking mechanism may be provided between the lever and the second housing to lock the housings together when the housings reach a properly connected state. The peak operation resistance preferably is larger than a resistance that acts when the housings are locked.

The housings are connected gradually as the lever is pivoted, and the operation resistance is peaked by the resistance means immediately before the housings are connected properly. The peak operation resistance is larger than the resistance that acts when the housings are locked. Thus, an inertial force pushes the second housing as the lever is pivoted to overcome the peak operation resistance. Consequently, the housings are connected properly and locked together with high reliability due to the inertial locking mechanism.

The resistance means preferably comprises a portion of the cam surface where a distance from the center of rotation decreases at a higher rate. More particularly, portions of the cam surface that contact the follower immediately before the housings are connected properly are inclined more steeply than other portions of the cam surface. Accordingly, the peak operation resistance is higher as the lever approaches the end of its pivotal movement. The peak operation resistance is obtained merely by changing the shape of the cam surface, and without providing a special resistance member. Thus, the resistance means is simple and inexpensive.

The resistance means preferably achieves the peak operation resistance when the housings have moved by a connection stroke larger than about 80%, preferably larger than 85%, and most preferably larger than 90% of a connection stroke needed to properly connect the housings. However, the resistance means preferably achieves the peak operation resistance when the housings have moved by a connection stroke less than 95% of a connection stroke needed to reach proper connection.

At least one starting position locking means may be provided on the lever, the first housing and/or the second housing to lock the lever temporarily in a starting position where the housings can be connected. Additionally, at least one releasing means may be provided for releasing the starting position locking means when the housings are to be mated so that the lever can pivot.

The invention also is directed to a method of assembling a lever-type connector. The method comprises partly mating first and second housings, and pivoting a lever on the first housing to connect the housings by the function of a cam means. An operation resistance of the lever is set to comprise a peak operation resistance when the lever is pivoted to a position immediately before the housings are connected properly connected.

The method may further comprise locking the two housings together with a locking mechanism when the housings reach a properly connected state.

Preferably, the peak operation resistance is larger than a resistance that acts when the housings are locked.

The method may comprise reaching a peak operation resistance when the housings have moved by a connection stroke larger than about 80%, preferably larger than 85% and most preferably larger than 90% of a connection stroke that properly connects the housings. However, the connection stroke for peak operation resistance preferably is less than 95% of a connection stroke needed to connect the housings properly.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
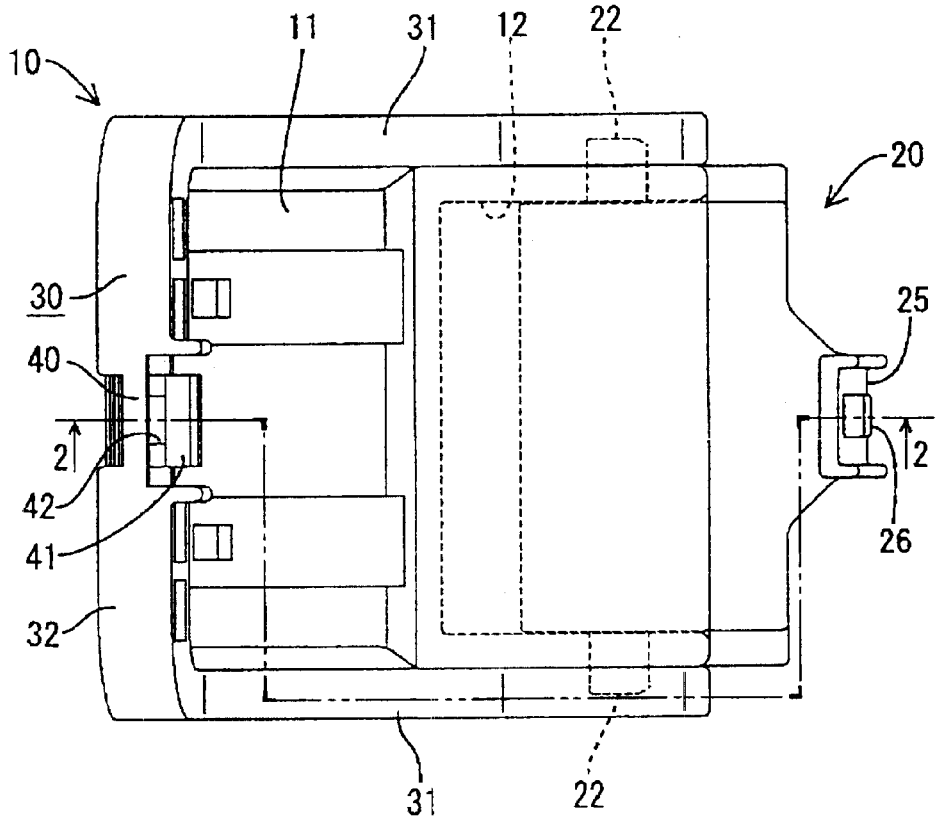
FIG. 1 is a plan view showing a connection initial state of male and female housings according to one embodiment of the invention.

A connector according to the invention has a male housing 10 and a female housing 20 that are connectable with each other. Sides of the housings 10, 20 that are to be connected are referred to herein as the front.

The male housing 10 is made e.g. of a synthetic resin and has a main body 11 and a receptacle 12 formed on the front surface of the main body 11. Male terminal fittings (not shown) are inserted from behind into cavities in the main body 11 and have tabs that project into the receptacle 12. Shafts 14 extend from lateral surfaces of the receptacle 12.

The female housing 20 also is made of synthetic resin, and is configured to fit into the receptacle 12 of the male housing 10. Female terminal fittings (not shown) are inserted into cavities in the female housing 20.

A synthetic resin lever 30 is mounted pivotally on the male housing 10. The lever 30 has two arms 31 and an operable portion 32 that extends between ends of the arms 31. A shaft hole 33 is formed in the middle of each arm 31, and the shafts 14 of the receptacle 12 extend through the shaft holes 33. Thus, the lever 30 is pivotable between a starting position shown in FIG. 2 and an end position shown in FIG. 5.

Each arm 31 of the lever 30 has a cam groove 35 at one side of the shaft hole 33. Each cam groove 35 is curved so that a distance from the shaft hole 33 gradually decreases from a starting end 35A toward a terminus 35B. In other words, the cam groove 35 has a substantially spiral shape so that its radial distance from the shaft hole 33 decreases in an azimuthal direction. An entrance 36 is open in the leading end edge of the arm 31 and communicates with the starting end 35A.

Cam follower pins 22 project from the lateral surfaces of the female housing 20 for engaging the cam groove 35. A longitudinally aligned entrance groove 16 is formed in the lateral surfaces of the receptacle 12 of the male housing 10 and allows the follower pin 22 to enter. As described later, each follower pin 22 move from the starting end 35A to the terminus 35B of the cam grooves 35 as the lever 30 is pivoted, and reaches the terminus 35B when the female housing 20 connects to the back end of the receptacle 12. It should be noted that a play is provided at the back of each terminus 35B.

Figure 2:
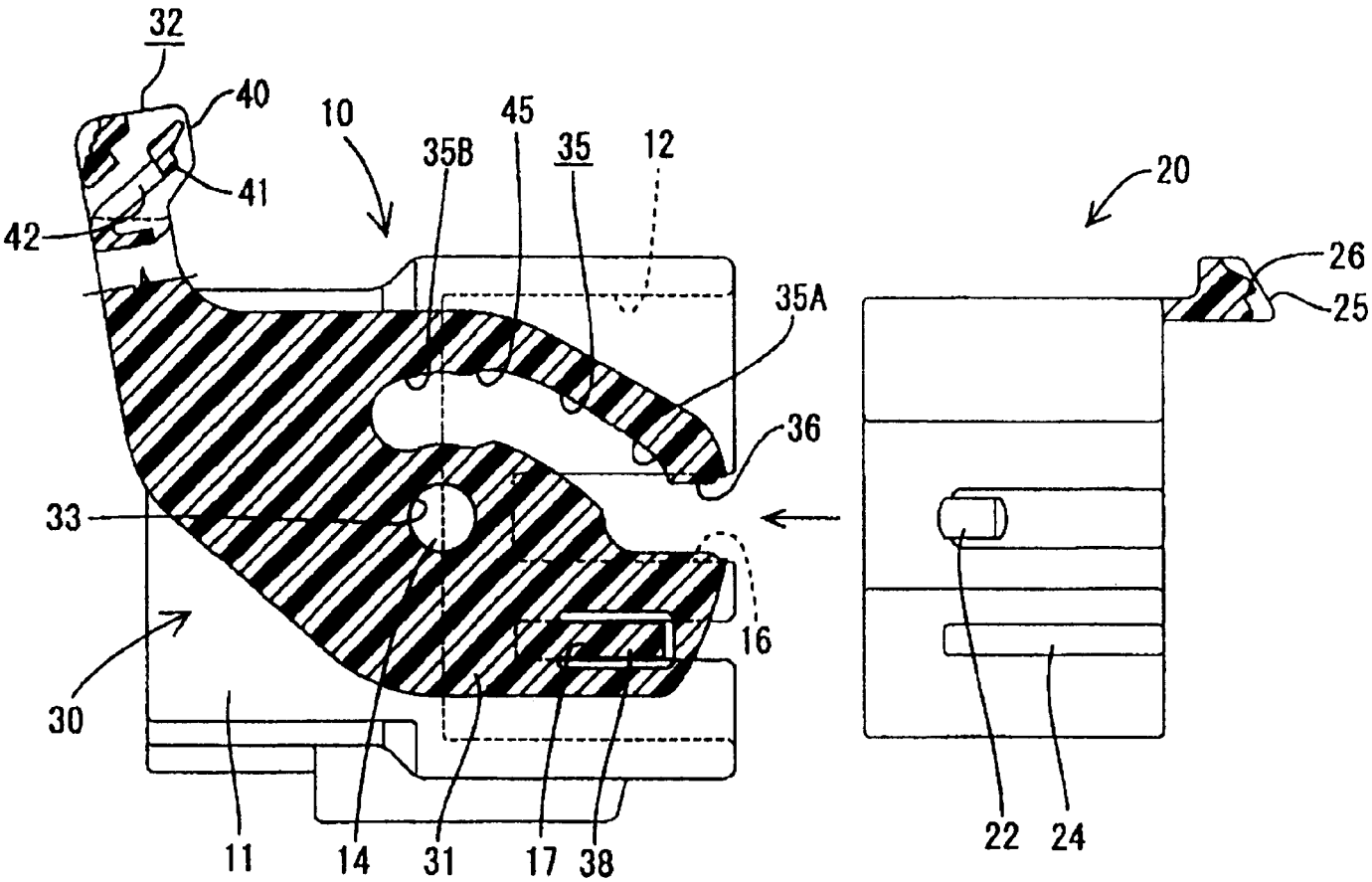
FIG. 2 is a section along 2—2 of FIG. 1 showing a state before the housings are connected.

A resiliently deformable partial lock 38 is cantilevered from the leading end of the arm 31 of the lever 30 at a side substantially opposite from the cam groove 35, and a forwardly open guide groove 17 extends forward and backward in each of the lateral surfaces of the receptacle 12. As shown in FIG. 2, the partial locks 38 fit resiliently into the guide grooves 17 to hold the lever 30 temporarily at the starting position and to prevent further pivoting. The entrances 36 of the cam grooves 35 align with the entrance grooves 16 and open forward when the lever 30 is at the starting end.

A rib 24 is formed on each of the lateral surfaces of the female housing 20 and can enter the corresponding guide groove 17. As the ribs 24 enter the guide grooves 17, the partial locking pieces 38 undergo a forced resilient deformation and exit the guide grooves 17. As a result, the pivoting movement of the lever 30 is permitted.

A lever-side lock 40 is provided in the widthwise center of the operable portion 32 of the lever 30 for locking the lever 30 at the end position. The lever-side lock 40 includes a resiliently deformable lock 41 that is formed with a lock groove 42.

Figure 5:
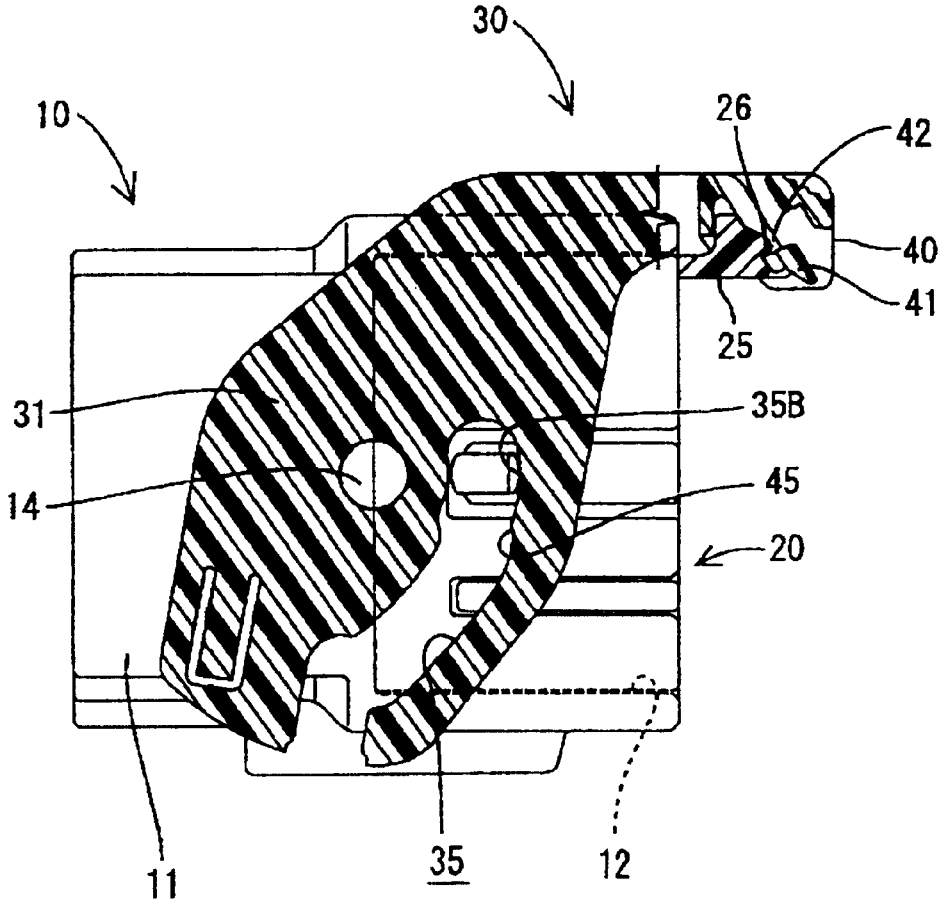
FIG. 5 is a section similar to FIG. 2, but showing a state where the two housings are connected properly.

A housing-side lock 25 is provided in the widthwise center at the rear of the upper surface of the female housing 20, and is dimension for contact by the lever-side lock 40. The housing-side lock 25 has a projection 26 engageable with the lock groove 42 of the lock 41. More specifically, as shown in FIG. 5, the lever-side lock 40 strikes against the housing-side lock 25 when the female housing 20 is fit properly into the receptacle 12 of the male housing 10 and the lever 30 is pivoted to the end position. Thus, the lock 41 moves beyond the projection 26 and deforms resiliently. Consequently, the projection 26 fits into the lock groove 42 to lock the housings 10, 20.

The distance from the shaft hole 33 decreases at a higher rate in a specified area 45 of each cam groove 35 located slightly before the terminus 35B than in other areas. Hence, the specified area 45 has a curved shape with a steep inclination. In other words, the derivative of the function that describes the shape of the cam groove 35 is higher in the specified area 45 as compared to other areas thereof. Preferably, the derivative increases in the specified area 45 shortly before the terminus 35B and then decreases again. Thus, operation resistance to the pivotal movement peaks and then decreases when the follower pins 22 pass the specified area 45.

Figure 6:
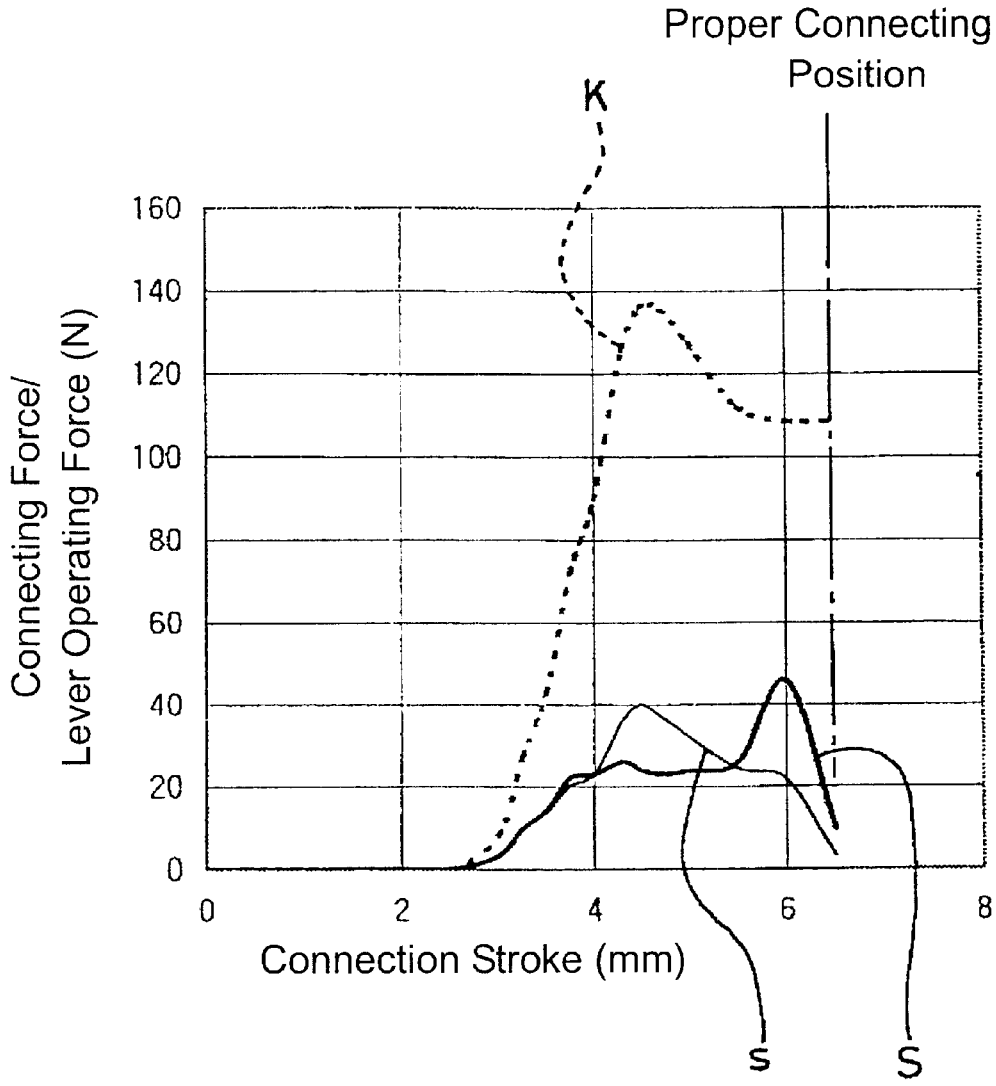
FIG. 6 is a graph showing characteristics of a connecting force and a lever operating force.

A connecting force necessary to connect the male and female housings 10, 20 is shown in the characteristic curve K of FIG. 6, The operation resistance to the pivotal movement of the lever 30 has been set conventionally to peak substantially at a middle stage of the pivotal movement corresponding to less than about 70% of the full pivotal movement of the lever or of the connection stroke of the two housings, as shown in a characteristic curve s of FIG. 6. However, the operation resistance to the pivotal movement of the lever 30 peaks immediately before the housings 10, 20 are connected properly with each other, as shown in a characteristic curve S of FIG. 6. This pivoting occurs when the lever 30 has been pivoted by more than about 80%, preferably more than about 85%, most preferably by more than about 90% of its full pivotal movement to connect the two housings 10, 20.

The peak operation resistance force is set larger than a resistance that acts when the lever 30 is locked. Thus, a sum of a resistance to engage the lock 41 and the projection 26 for locking and a resistance acting between the two housings 10, 20 being connected at this time.

The female housing 20 fits into the receptacle 12 of the male housing 10, as shown by an arrow of FIG. 2, with the lever 30 held at the starting position. In an initial fitted state, the follower pins 22 of the female housing 20 enter the entrance grooves 16 and are located at the entrances 36 of the cam grooves 35 as shown in FIG. 3.

Figure 3:
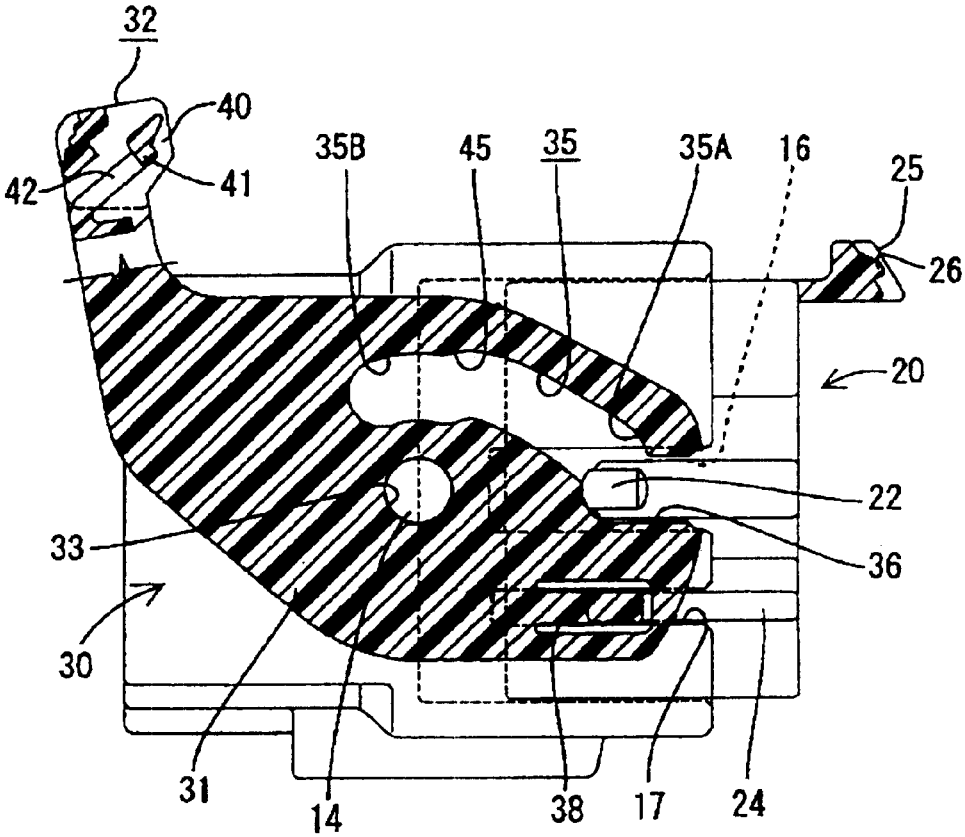
FIG. 3 is a section similar to FIG. 2, but showing an initial connection state of the two housings.

A finger is placed on the operable portion 32 to pivot the lever 30 in clockwise direction of FIG. 3 in this state. Thus, the follower pins 22 enter the starting ends 35A of the cam grooves 35 through the entrances 36, and the female housing 20 is pulled gradually into the receptacle 12 of the male housing 10 while the follower pins 22 are pressed toward the shafts 14 mainly by the outer surfaces (upper surfaces in FIG. 3) of the cam grooves 35.

Figure 4:
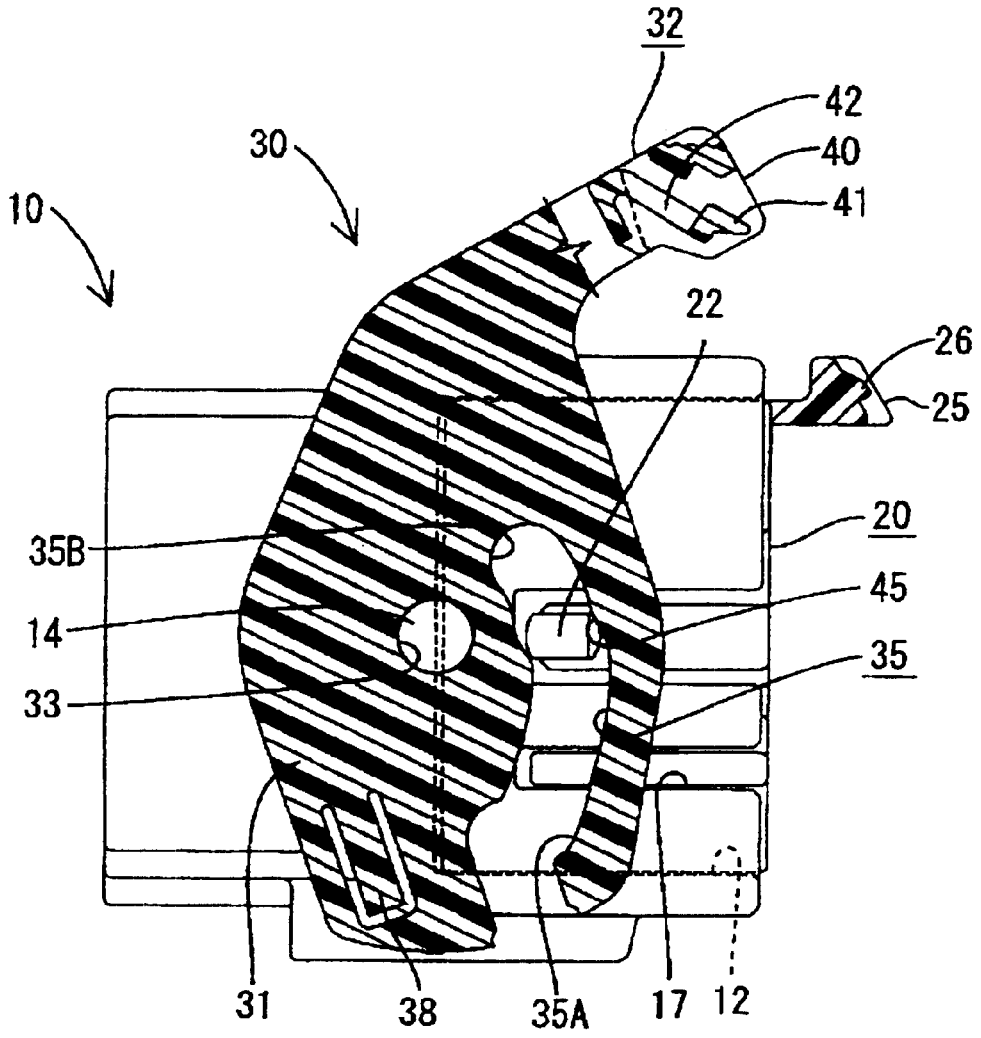
FIG. 4 is a section similar to FIG. 2, showing a state where the lever experiences a peak operation resistance.

The lever 30 is pivoted further to reach a state immediately before the housings 10, 20 are connected properly, and the steep surface areas 45 of the cam grooves 35 press the follower pins 22, as shown in FIG. 4. The peak operation resistance given to the lever 30 is shown in the curve S of FIG. 6.

The peak operation resistance is larger than a sum of the resistance required to engage the lock 41 and the projecting portion 26 for locking and the resistance acting between the two housings 10, 20 being connected. If the lever 30 is pivoted against the peak operation resistance, then the female housing 20 is pushed by an inertial force by way of the engagement of the cam grooves 35 and the follower pins 22. Consequently, the two housings 10, 20 are connected properly and lock together by the engagement of the lock 41 and the projection 26, as shown in FIG. 5.

As described above, the two housings 10, 20 can be connected properly with high reliability due to the inertial locking mechanism. Thus, the corresponding male and female terminal fittings can be connected precisely.

The steep surface area 45 whose distance from the center of rotation decreases at a higher rate, as compared to the other areas, is formed at the specified side surface of the cam groove 35 as a means for giving a high resistance to the lever 30 to form an inertial lock. Such a means can be simple.

The invention is not limited to the above described and illustrated embodiment. For example, the following embodiment also is embraced by the technical scope of the invention as defined in the claims. Beside the following embodiment, various changes can be made without departing from the scope and spirit of the present invention as defined in the claims.

Depending on the shape and other factors of the connector, the lever may be mounted on the female housing and the follower pins may be on the male housing unlike the foregoing embodiment.

Even though the lever 30 for assisting or performing the connection of the male and female housings 10, 20 is pivotal, the lever may move along another path, such as a substantially linear path, and cam means assist the connection of the male and female connector housings 10, 20 when moved.

What is claimed is:

1. A lever-type connector, comprising:

first and second housings connectable with each other;

a lever pivotably supported on the first housing, the lever having at least one cam surface with a curved shape configured such that a distance from the cam surface to a center of rotation of the lever gradually decreases between a starting end and a terminus of the cam surface;

at least one follower provided on the second housing and being engageable with the cam surface so that the housings are connected as the lever is pivoted; and a resistance means on the cam surface for giving a peak operation resistance to the lever when the lever is pivoted to a position reached immediately before the two housings are connected properly and so that operation resistance to the lever decreases continuously from the position of peak operation resistance to a position where the two housings are connected properly.

2. The lever-type connector of claim 1, wherein a locking mechanism is provided between the lever and the second housing to lock the two housings together when the two housings reach a properly connected state.

3. The lever-type connector of claim 2, wherein the peak operation resistance is larger than a resistance acting when the two connector housings are locked.

4. The lever-type connector of claim 1, wherein the resistance means is formed by providing the cam surface with a portion whose distance from the center of rotation decreases in a direction from the starting end to the terminus at a higher rate than at other locations on the cam surface.

5. The lever-type connector of claim 1, wherein the resistance means is provided such that the peak operation resistance is reached when the housings have moved through a connection stroke larger than about 80% of a stroke needed to reach the properly connected state of the two housings.

6. The lever-type connector of claim 5, wherein the resistance means is provided such that the peak operation resistance is reached when the two housings have moved through a connection stroke less than 95% of a connection stroke needed to reach the properly connected state of the two housings.

7. The lever-type connector of claim 1, wherein a starting position locking means is provided on at least one of the lever, the first housing and the second housing to lock the lever temporarily in a starting position where the two housings can be connected with each other.

8. The lever-type connector of claim 7, wherein at least one releasing means is provided for releasing the locking function of the starting position locking means when the housings are started to be mated so that the lever can be pivoted.

9. A lever-type connector, comprising:

first and second housings connectable with each other;

a lever supported pivotally on the first housing, the lever having at least one cam surface with an open starting end, a closed terminus and a curved shape between the starting end and the terminus, the curved shape being configured such that a distance from a center of rotation of the lever to the cam surface gradually decreases between the staring end and the terminus;

at least one follower provided on the second housing and being engageable with the cam surface so that the housings are connected as the lever is pivoted; and a resistance means formed on the cam surface closer to the terminus than to the starting end for giving a peak operation resistance to the lever when the lever is pivoted to a position before the housings are connected properly and so that operation resistance to the lever decreases continuously from the position of peak operation resistance to a position where the housings are connected properly.

10. The lever-type connector of claim 9, wherein a locking mechanism is provided between the lever and the second housing to lock the housings together when the housings are connected properly, the peak operation resistance being larger than a resistance acting when the connector housings are locked together.

11. The lever-type connector of claim 10, wherein the resistance means is a portion of the cam surface where a distance from the center of rotation to the cam surface decreases in a direction from the starting end to the terminus at a higher rate than at other locations on the cam surface.

12. The lever-type connector of claim 11, wherein the resistance means is provided such that the peak operation resistance is reached when the housings have moved through a connection stroke larger than about 80% of a stroke needed for the housings to be connected properly.

13. The lever-type connector of claim 12, wherein the resistance means is provided such that the peak operation resistance is reached when the two housings have moved through a connection stroke less than 95% of a connection stroke needed for the housings to be connected properly.

* * * * *